US005680776A

United States Patent [19]

Shenhav

[11] Patent Number: 5,680,776

[45] Date of Patent: Oct. 28, 1997

[54] METAL MOUNT FOR CUT JEWELS AND ACCESSORIES

[75] Inventor: Eran Shenhav, Pforzheim, Germany

[73] Assignee: Feeling The Collection Schmuckwaren GmbH, Pforzheim, Germany

[21] Appl. No.: 426,726

[22] Filed: Apr. 21, 1995

[30] Foreign Application Priority Data

Apr. 4, 1995 [JP] Japan ..... 7-103082

[51] Int. Cl.[6] ..... A44C 17/02

[52] U.S. Cl. ..... 63/26; 63/27

[58] Field of Search ..... 63/26, 27

[56] References Cited

U.S. PATENT DOCUMENTS 2,763,140 9/1956 Lutrario ..... 63/27 X

FOREIGN PATENT DOCUMENTS 63-199610 12/1988 Japan .
5-37041 6/1993 Japan .

OTHER PUBLICATIONS

Les Joyaux Magazine, Jul. 1985, p. 112.
Les Joyaux Magazine, May 1986, p. 112.

*Primary Examiner*—Blair Johnson
*Attorney, Agent, or Firm*—Oliff & Berridge

[57] ABSTRACT

A metal mount for cut jewels and accessories maintains the firm mounting of jewels, can be assembled easily and prevents an upper leg portion from blocking the bright flat upper surface of a cut jewel. The metal mount includes a metal base and a fixture, the metal base being laterally U-shaped, having an upper leg, a lower leg that is longer than the upper leg, and a curved saddle located between the upper and lower legs. The upper leg forks horizontally into two branches, and the lower leg has a depression near the end. The fixture is fixed so as to be partially located between the saddle of the metal base and the depression. The tip of a conical portion of the jewel is inserted into the depression, and the upper leg is pressed against a flat upper surface of the jewel. Since each end of the branches of the upper leg is offset from the center of the upper surface of the jewel, counteracting rotation moments are generated around the depression to enable the jewel to be supported in a stable position at four points: the depression, a side of the fixture, and the two forking arms of the upper leg.

6 Claims, 6 Drawing Sheets

METAL MOUNT FOR CUT JEWELS AND ACCESSORIES

BACKGROUND OF THE INVENTION

1. Field of the Invention

The present invention relates to a bracket or a metal mount (hereinafter referred to as "a bracket") for jewels that have been cut so as to have a flat upper surface and a conical or pyramidal portion on the lower surface, and to a personal ornament or accessory (hereinafter referred to as "a personal ornament"), for example, a ring or a pendant for a necklace, having at least one cut jewel fitted into the bracket.

2. Description of the Related Art

Jewels such as facet and brilliant cut jewels that have been cut so as to have a flat upper surface and a conical or pyramidal portion on the lower surface (hereinafter referred to as "cut jewels") are fixed so that a plurality of nails protruding upward from a base can grip the crown or bezel of the jewel and press the jewel against the base. Production of such mounting structures requires skilled craftsmen. In addition, special metal bases must be stored for different sizes, shapes, and cuts of jewels. Furthermore, metal bases having clip-like fasteners are relatively cumbersome because these fasteners may be warped when subjected to inadvertent loads (impacts), such as, caught by clothes, resulting in the loss of jewels. The base and nails may cover or block the lower surface (pavilion) of a cut jewel, thereby reducing incident rays from the outside.

To solve the above problem, a structure for mounting cut jewels has been proposed which comprises a bracket with a hole for receiving the tip of the curette and pavilion of the jewel and a nail protruding upward from one end of the bracket to reach the girdle of the jewel and to cover at least one corner of both the crown and the girdle and having two working sections (see Laid-Open Utility Model Sho. 63-199, 610).

This improved mounting structure grips a cut jewel at three points, that is, the hole and the two working sections of the nail. This structure has an advantage that it receives more incident rays than in the prior art to improve the brightness of the jewel because the smaller number of nails serve to expose the lower portion (pavilion) of the jewel. Since, however, this structure uses the nail to press the crown, the crown is retained properly if the nail has an angle smaller than 45° (45° being the ideal angle), whereas the jewel may fall off if the nail has an angle larger than 45°. In this case, the need to increase the interval between working sections forces the structure to have a large width, but the allowable width is restricted due to design limitations. In addition, the assembly is complicated because the nail must be positioned so as to correspond to the cut surface (a bezel facet or an upper girdle facet) constituting the crown.

To solve the above problem, the invention described in Japanese Patent Publication Hei. 5-37041 has been proposed. The invention described in the publication discloses a bracket for cut jewels and a personal ornament, wherein a lower portion of the cut jewel is exposed and a flat upper surface of the cut jewel, which is not affected by the angle of a crown and the cut surface constituting the crown, is a portion to be fixed. The present invention is made further to improve the invention described in Japanese Patent Publication Hei.5-37041, and attempts to prevent the upper leg in contact with the flat upper surface (table) of the cut jewel from blocking the brightness of the jewel that can otherwise be seen through the upper surface while keeping the assembly strong and easy to manufacture.

SUMMARY OF THE INVENTION

To attain the above object, a bracket according to the present invention for mounting a cut jewel 12 having a flat portion 13 on the upper surface and a conical portion 14 on the lower surface includes a laterally U-shaped metal base 11 having an upper leg 16 and a lower leg 17 that is longer than the upper leg 16. The base 11 is fixed 23 to a fixture for sandwichedly vertically supporting the jewel 12, in which the upper leg 16 horizontally forks into two branches, and a depression 20 that forms a seat for the tip of the conical portion 14 of the jewel is provided at the end of the lower leg 17. The fixture 23 is fixed so as to be partially located between the saddle of the metal base 11 and the depression 20, and the side of the fixture 23 is pressed against the surface of the conical portion 14 of the jewel when the jewel is fixed by pressing the upper forking leg 16 against the flat upper surface 13 of the jewel and fitting the tip of the conical portion 14 of the jewel into the depression 20 of the lower leg 17. A personal ornament according to the present invention includes the laterally U-shaped metal base 11 having the upper leg 16 forking horizontally into two branches and the lower leg 17 that is longer than the upper leg 16. The base is fixed to an annular body 23 for vertically sandwichedly supporting the jewel, in which the depression 20 that forms a seat for the tip of the conical portion 14 of the jewel is provided at the end of the lower leg 17. The annular body 23 is disposed so as to be partially located between the saddle 18 of the metal base 11 and the conical portion 14 of the jewel. The jewel is fixed and the side of the annular body 23 is pressed against the surface of the conical portion 14 of the jewel by pressing the upper forking leg 16 against the flat upper surface 13 of the cut jewel 12 and fitting the tip of the conical portion 14 into the depression 20 of the lower leg 17.

Since the present invention has the above configuration, the cut jewel 12 is supported at four points, that is, the conical portion 14 of the lower surface, the flat portion 13 of the upper surface, and the side of the conical portion 14 are fixed reliably by the depression 20 of the metal base 11, the upper leg 16 of the metal base 11 which forks into two branches, and part of the fixture 23, respectively.

Since the upper leg 16 is shorter than the lower leg 17, the tip of the upper leg 16 does not reach the center of the flat upper surface 13 of the jewel 12. In addition, since the upper leg 16 forks into two branches, their tips are offset from the center of the flat upper surface 13 of the jewel 12. This serves to provide a unique appearance and to generate a rotation moment around the depression 20, thereby causing the side of the conical portion 14 of the jewel 12 to be fixed by the fixture 23 and the flat upper surface 13 of the jewel to be fixed by the two spaced portions comprising the upper leg 16 forking into two branches, thereby maintaining stable assembly conditions.

Furthermore, if the relative positioning of the jewel 12 and the fixture 23 is variable, the variation, to some extent is absorbed by the four-point support structure.

DESCRIPTION OF THE PREFERRED EMBODIMENTS

Figure 1:
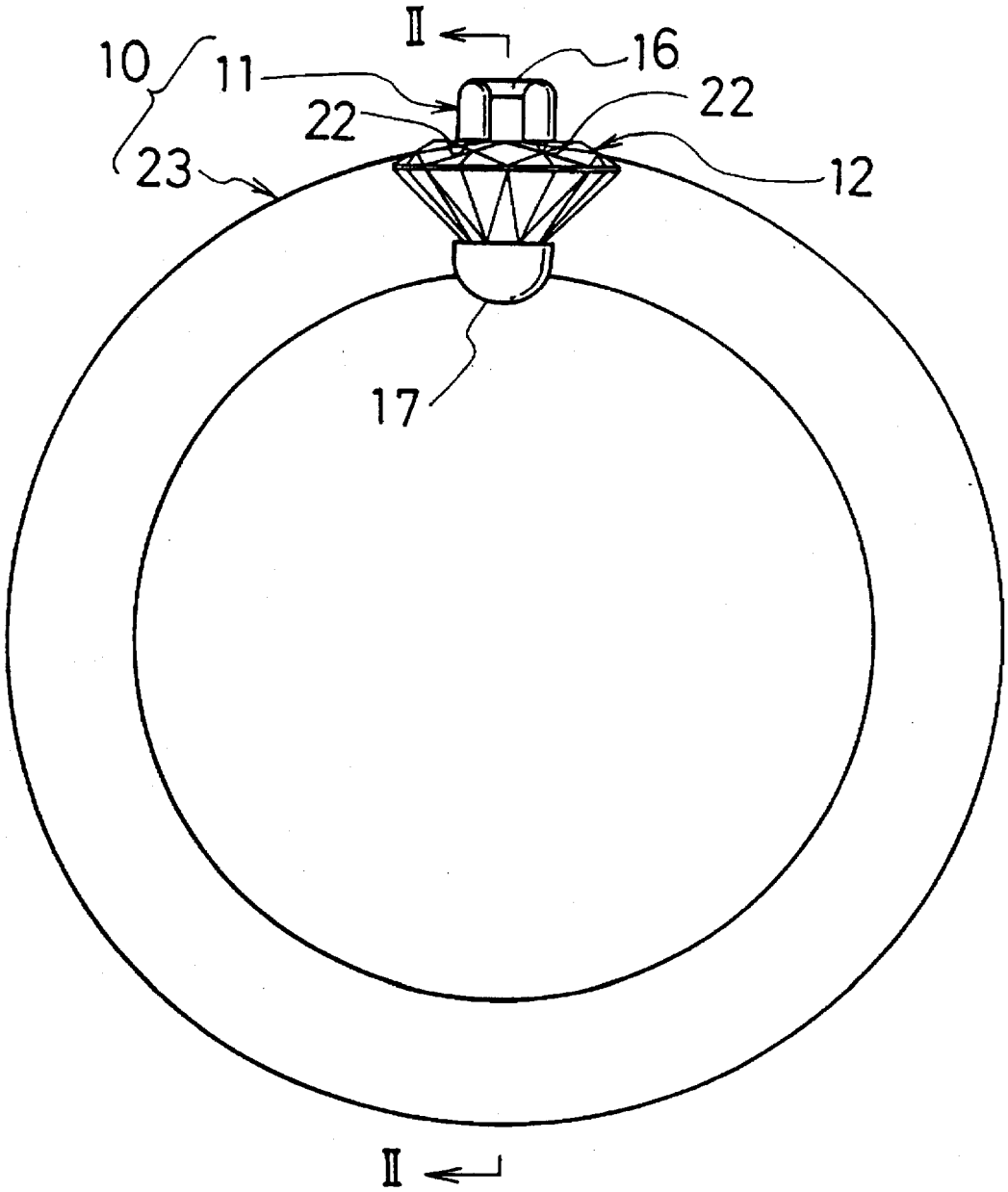
FIG. 1 is a front elevational view of a first embodiment of the present invention.

A first embodiment of the present invention is described below with reference to FIGS. 1 to 4.

A ring shown in the figures as a personal ornament includes a cut jewel fitted into a bracket 10 according to the present invention. The bracket 10 comprises a metal base 11 and a fixture 23.

A jewel 12 is brilliant-cut in this case. The upper surface of the jewel 12 is called a table and formed as a substantially flat surface 13, and the lower surface is called a pavilion and tapered to form a generally pyramidal or conical portion 14 (hereinafter referred to as a "conical portion"). The tip of the pavilion 14 is called a curette.

The metal base 11 is a laterally U-shaped fitting, and comprises an upper leg 16 forking horizontally into forking arms 16*a*, 16*b*, a lower leg 17, and a curved saddle 18 located between the upper and the lower legs 16, 17. The upper leg 16 is shorter than the lower leg 17.

Figure 2:
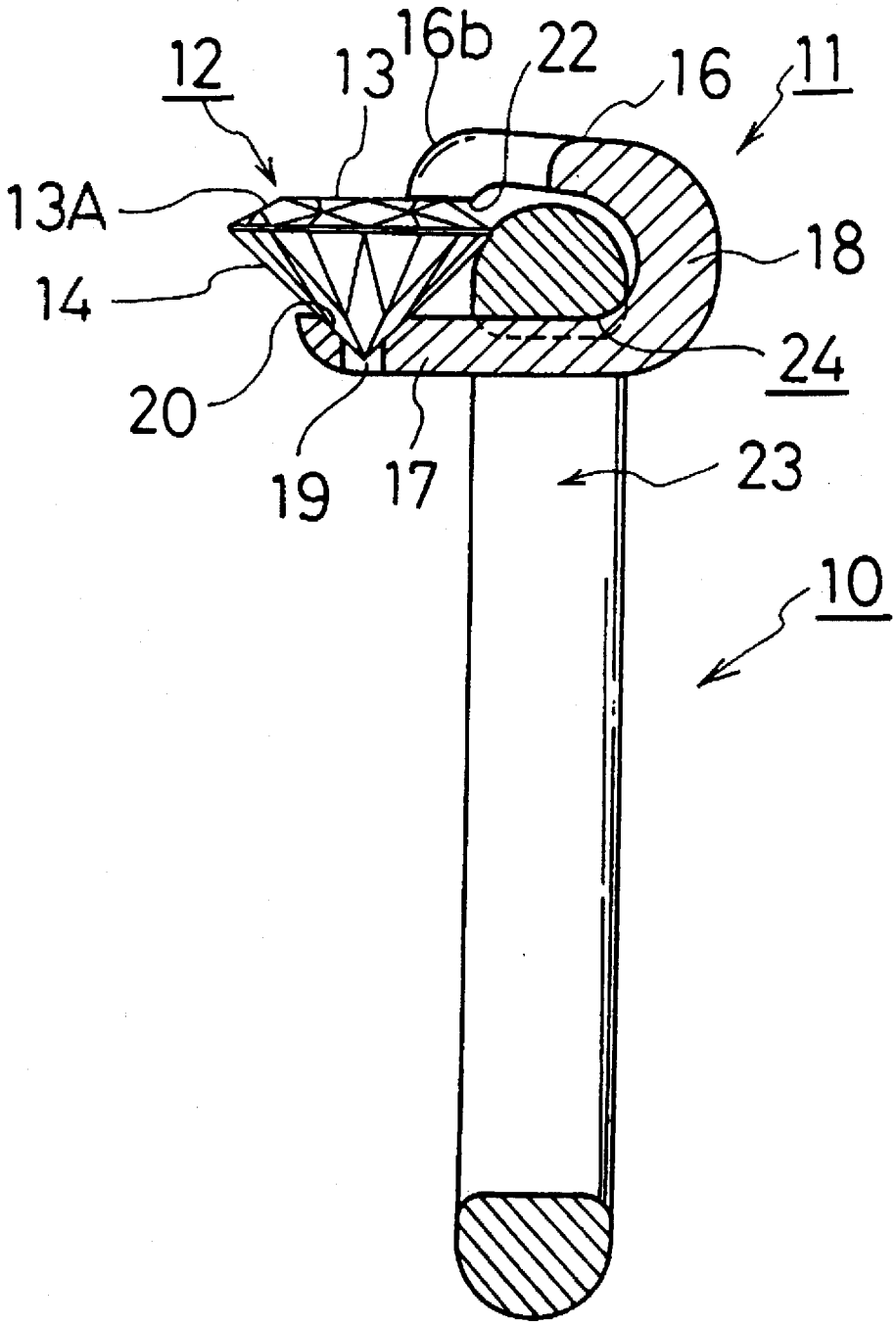
FIG. 2 is a vertical cross sectional view along line II—II in FIG. 1.
Figure 3:
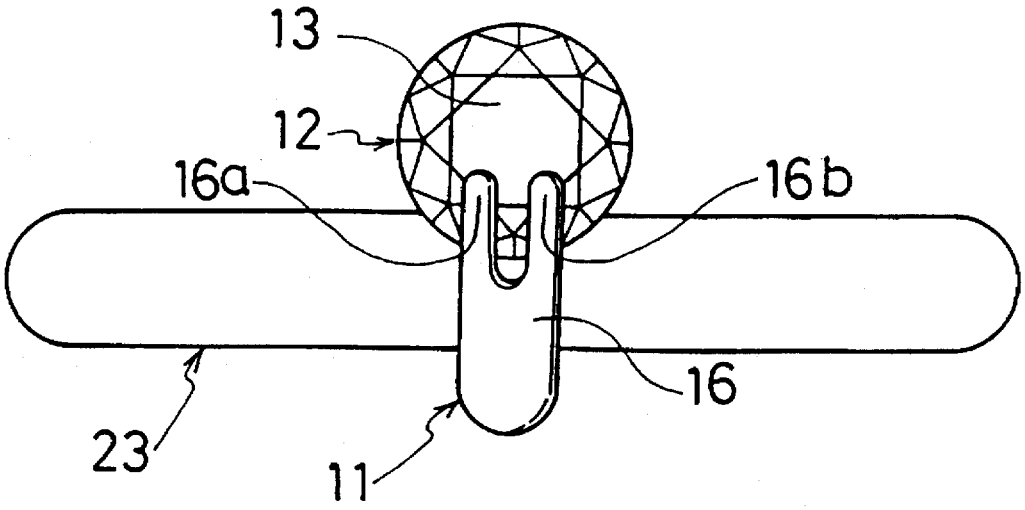
FIG. 3 is a plan view of the first embodiment of the present invention in FIG. 1.
Figure 4:
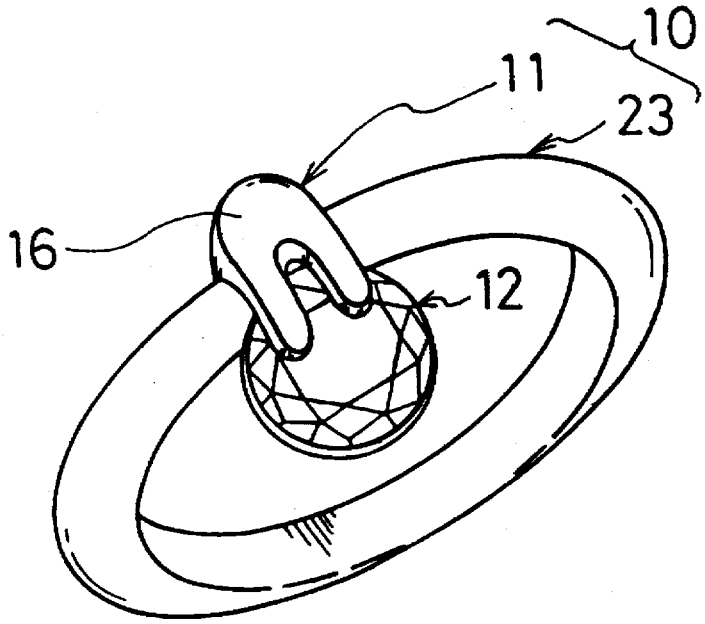
FIG. 4 is a perspective view of the first embodiment of the present invention in FIG. 1.
Figure 5:
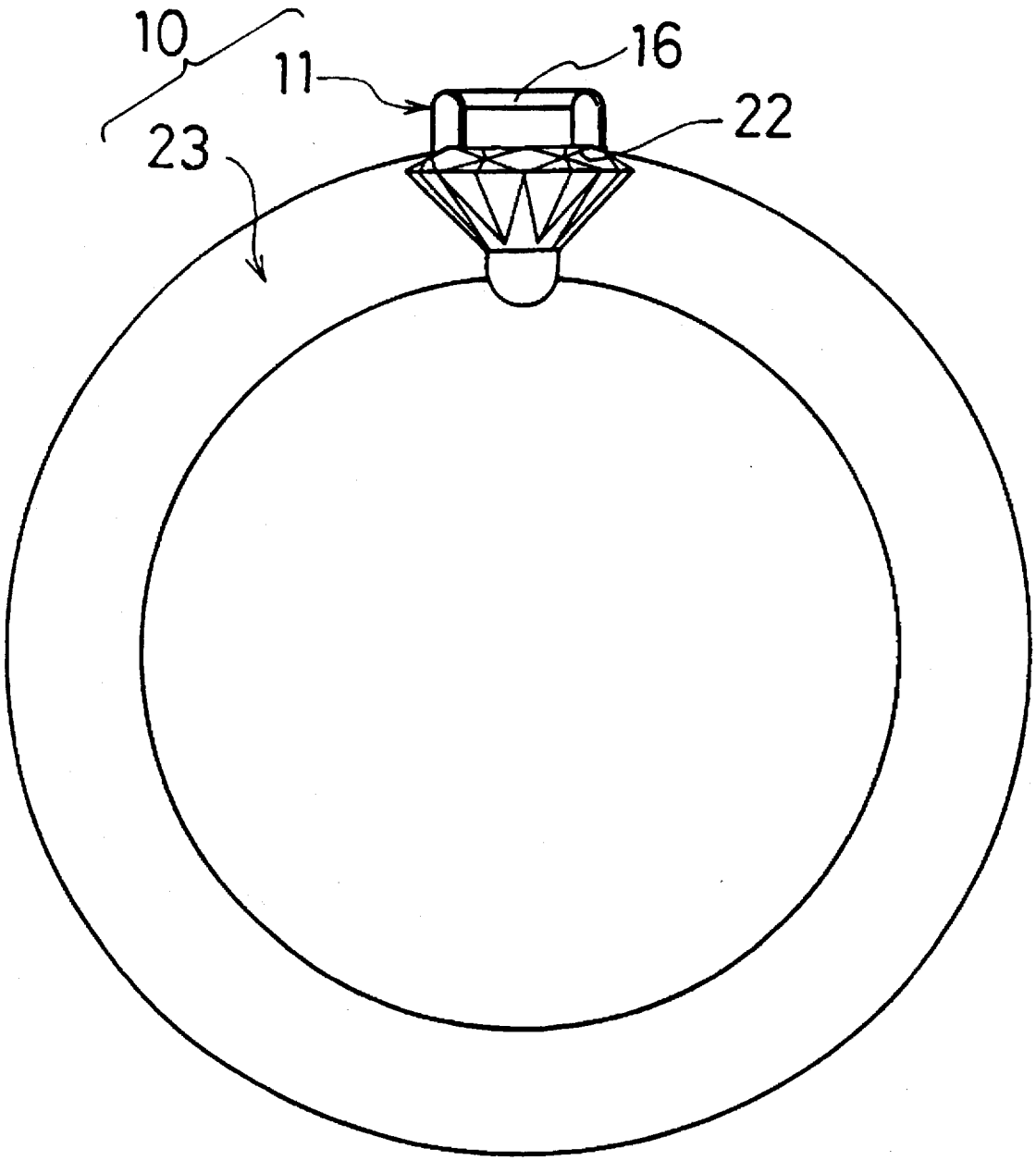
FIG. 5 is a front elevational view of a second embodiment of the present invention.
Figure 6:
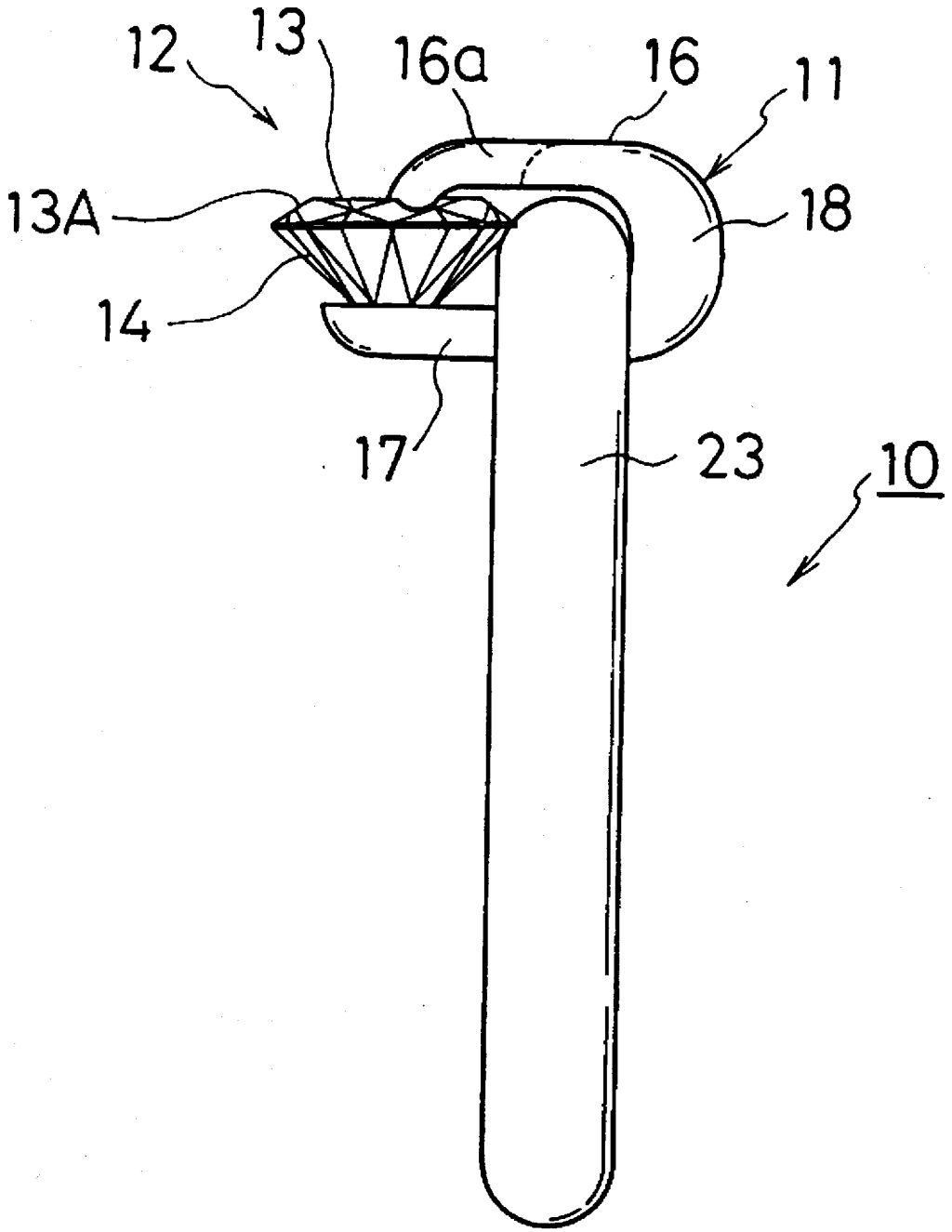
FIG. 6 is a right side view of the second embodiment of the present invention in FIG. 5.
Figure 7:
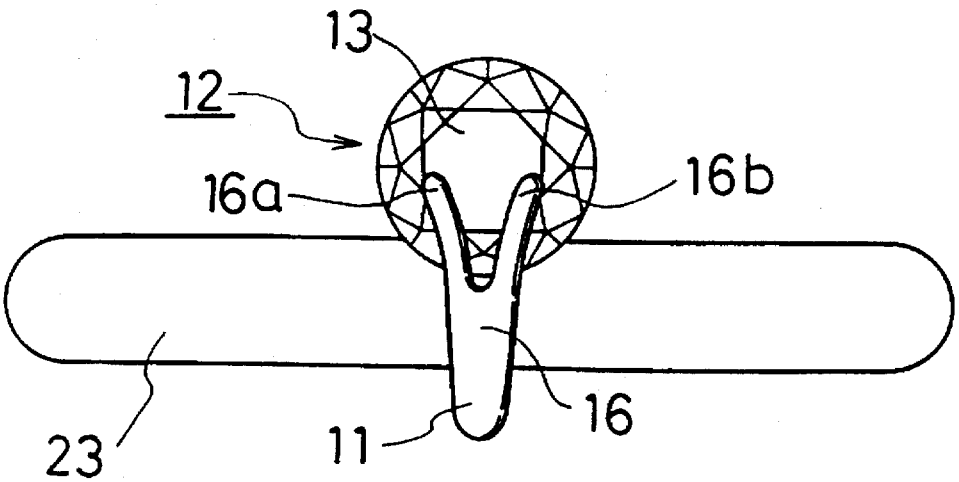
FIG. 7 is a plan view of the second embodiment of the present invention in FIG. 5.
Figure 8:
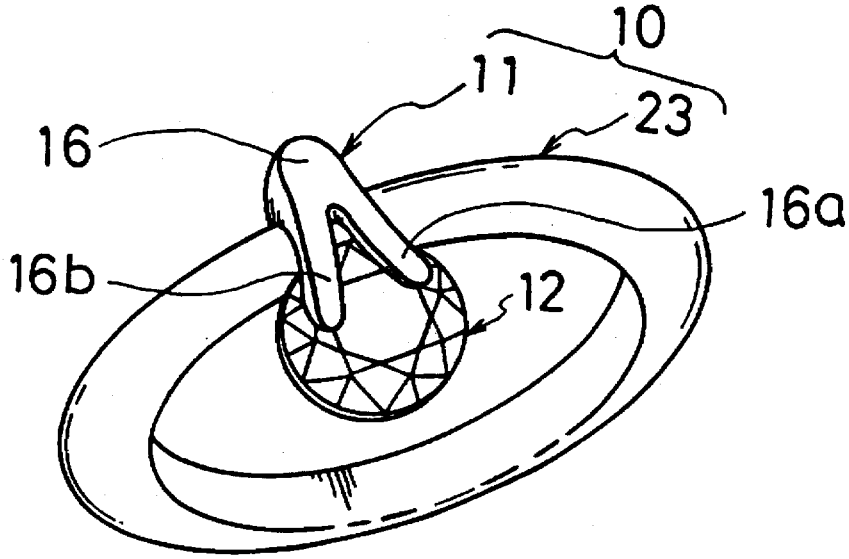
FIG. 8 is a perspective view of the second embodiment of the present invention in FIG. 5.

As shown in FIG. 2, a hole 19 with a conical depression 20 is perforated inside the lower leg 17. The depression 20 acts as a seat for the tip of the conical portion 14 of the jewel 12. The jewel 12 is pushed into the depression 20 of the lower leg 17 by the forking arms 16*a*, 16*b* that constitute the tip of the upper leg 16 and press the flat surface 13, and is sandwichedly supported by the upper leg 16 and the lower leg 17. In this embodiment, the forking arms 16*a*, 16*b* are constructed to extend in parallel and look approximately U-shaped in a plan view. As shown in FIGS. 1 and 2, each of the forking arms 16*a*, 16*b* of the upper leg 16 have outwardly round upper surfaces and substantially flat lower surfaces that are inner surfaces 22, and stably rest on the flat surface 13 of the jewel at a certain interval.

An annular body (fixture) 23 of the ring is inserted between the saddle 18 and the conical portion 14 of the jewel 12 to lockingly engage the metal base 11. For this purpose, a recess 24 is perforated in the fixture 23, and the metal base 11 is brazed with the fixture 23 via the contact surface of the recess 24. Also, the upper leg 16 is made to be much shorter than the lower leg 17 such that it does not reach the center of the flat surface 13 of the jewel to be set.

The ring illustrated in the figures is manufactured as follows. First, part of the annular body (fixture) 23 is filed to perforate a recess 24 therein. Next, the lower leg 17 of the laterally U-shaped metal base 11 is brazed with the recess 24 with the base somewhat opened. A hole 19 and a depression 20 are subsequently perforated on the lower leg 17 according to the size of the jewel 12 to fit.

The jewel 12 is inserted into the depression 20, and cutting pliers or hand presses are then used to press the upper leg 16 against the flat surface 13. Since the upper leg 16 is shorter than the lower leg 17, a "decentering" pressure is applied to the jewel 12 and causes it to tilt clockwise in FIG. 2, resulting in the conical portion 14 of the jewel 12 being fitted onto the outer surface of the fixture 23 located inside the saddle 18. The conical portion 14 is also somewhat pushed into the fixture 23. In this manner, only the bending of the upper leg 16 enables the jewel 12 to be supported at four points: the depression 20, the side of the fixture 23, and the two forking arms 16*a*, 16*b* of the upper leg 16.

Although in the above embodiment, the fixture 23 has a circle cross section, the present invention is also applicable to annular bodies having a cross section differing from a circle. The metal base 11 can be employed for jewels other than brilliant-cut types, for example, square cut jewels. For both rings and arm rings, a plurality of jewels can be mounted in the bracket according to the present invention, and allowed to protrude horizontally and alternately from one or the other side of the fixture 23.

Next, a second embodiment of the present invention is described with reference to FIGS. 5 to 8.

In the description of the second embodiment, similar or the same members carry the same reference numerals as in the first embodiment, and their description is omitted.

In the second embodiment, the forking arms 16*a*, 16*b* of the upper leg 16 are opened horizontally like an approximate V or Y shape, and the tips of the forking arms 16*a*, 16*b* abut the flat surface 13 of the jewel, or simultaneously abut the flat surface 13 and an inclined surface 13A around the flat surface 13.

The present invention thus constructed provides a bracket for jewels which easily and reliably retains the jewel and a personal ornament having jewels fitted into the bracket, and eliminates the need to store special metal bases for different sizes, shapes, and cuts of jewels. This enables such personal ornaments to be produced easily and quickly, thereby improving working efficiency and reducing costs. On the other hand, since the jewels are retained reliably by the metal base, the risks of loss of jewels by the personal ornament's users due to inadvertent loads may be reduced.

In addition, since the jewel is fixed reliably at four points, the number of steps for assembling is reduced, thereby facilitating workability, compared to a fixture with nails.

Further, the mounting of jewels also becomes more reliable because the side of the conical portion and flat upper surface of the jewel are pressed by a rotation moment around the depression, resulting in the jewel being fixed reliably at four points.

Furthermore, since the upper and lower surfaces of the jewel are sandwichedly supported by the upper forking leg and lower leg of the metal base and the forking arms of the upper leg abut the flat upper surface of the jewel such that they are offset from the center of the upper surface and are spaced as required, stable mounting of the jewels may be obtained. The forking of the upper leg allows the middle of the flat surface to be exposed to improve the beauty of the jewel. A unique beauty may also be obtained by designing the forking arms to be opened like a U, V, or Y shape.

What is claimed is:

1. A metal mount for a cut jewel having a flat portion on an upper surface and a conical portion on a lower surface, comprising:

a laterally U-shaped metal base having an upper leg and a lower leg that is longer than the upper leg, the upper leg being connected to the lower leg by a saddle of the U-shaped metal base; and a fixture fixed to the base such that the base and the fixture vertically support the jewel when the jewel is located between the upper and lower legs;

wherein the upper leg horizontally forks into two branches;

wherein a depression that forms a seat for a tip of the conical portion of the jewel is provided near an end of the lower leg; and wherein the fixture is fixed so as to be partially located between the saddle of the metal base and the depression such that when the jewel is mounted in the fixture, a side of the fixture is pressable against a contact surface of the conical portion of the jewel, the branches of the upper forking leg are pressable against the flat portion of the upper surface of the jewel and the tip of the conical portion of the jewel is fittable into the depression of the lower leg, each branch of the upper leg being located on opposite sides of the contact surface and the depression.

2. A metal mount for a cut jewel as claimed in claim 1, wherein tips of the upper leg forking into two branches are deformed for simultaneously abutting the flat upper surface of the jewel and an inclined surface around the flat surface.

3. A jewel support member, comprising:

at least one metal mount for a cut jewel having a flat portion on an upper surface and a conical portion on a lower surface; and a laterally U-shaped metal base having an upper leg forking horizontally into two branches and a lower leg that is longer than the upper leg, the upper leg being connected to the lower leg by a saddle of the U-shaped metal base wherein said metal base is fixed to an annular body for vertically gripping the jewel, wherein a depression that forms a seat for a tip of the conical portion of the jewel is provided near an end of the lower leg, wherein the annular body is located between the saddle of the metal base and the conical portion of the jewel, wherein a side of the annular body is pressable against a contact surface of the conical portion of the jewel, wherein the branches of the upper forking leg are pressable against the flat portion on the upper surface of the cut jewel, and wherein the tip of the conical portion of the jewel is fittable into the depression of the lower leg, each branch of the upper leg being located on opposite sides of the contact surface and the depression.

4. A jewel support member as claimed in claim 3, wherein tips of the upper leg forking into two branches are deformed for simultaneously abutting the flat portion of the upper surface of the jewel and an inclined surface around the flat surface.

5. A mount for a cut jewel having a flat portion on an upper surface and a conical portion on a lower surface, comprising:

a fixture for supporting the jewel;

a U-shaped base attached to the fixture and defining first and second legs interconnected by a connector portion, the first leg being longer than the second leg, portions of the first and second legs and the connecting portion surrounding the fixture, and the first leg having a depression forming a seat for the conical portion;

wherein the fixture has a side point for contacting the jewel such that the side point, the depression and a center line of the connector portion define a support plane; and wherein the second leg is split to define first and second forks for contacting the upper surface of the jewel at two contact points symmetrically located on opposite sides of the support plane.

6. A mount for a cut jewel having a flat portion on an upper surface, a conical portion on a lower surface, and inclined surfaces between the flat portion on the upper surface and the conical portion on the lower surface, the mount comprising:

a fixture for supporting the jewel;

a U-shaped base attached to the fixture and defining first and second legs interconnected by a connector portion, the first leg being longer than the second leg, portions of the first and second legs and the connecting portion surrounding the fixture, and the first leg having a depression forming a seat for the conical portion;

wherein the fixture has a side point for contacting the jewel such that the side point, the depression and a center line of the connector portion define a support plane; and wherein the second leg is split to define first and second forks for contacting the inclined surfaces of the jewel at two contact points symmetrically located on opposite sides of the support plane.

* * * * *